US011024453B2

(12) United States Patent
Yasuda et al.

(10) Patent No.: US 11,024,453 B2
(45) Date of Patent: Jun. 1, 2021

(54) COIL DEVICE

(71) Applicant: TDK CORPORATION, Tokyo (JP)

(72) Inventors: Masatoshi Yasuda, Tokyo (JP); Hideaki Harata, Tokyo (JP)

(73) Assignee: TDK CORPORATION, Tokyo (JP)

( * ) Notice: Subject to any disclaimer, the term of this patent is extended or adjusted under 35 U.S.C. 154(b) by 392 days.

(21) Appl. No.: 16/117,775

(22) Filed: Aug. 30, 2018

(65) Prior Publication Data

US 2019/0080836 A1 Mar. 14, 2019

(30) Foreign Application Priority Data

Sep. 8, 2017 (JP) ..... JP2017-173412

(51) Int. Cl.

| | |
|---|---|
| ***H01F 27/29*** | (2006.01) |
| ***H01F 27/28*** | (2006.01) |
| ***H01F 27/24*** | (2006.01) |
| ***H01F 27/32*** | (2006.01) |
| ***H01F 5/02*** | (2006.01) |
| ***H01F 27/30*** | (2006.01) |

(52) U.S. Cl.

CPC ..... *H01F 27/2823* (2013.01); *H01F 5/02* (2013.01); *H01F 27/24* (2013.01); *H01F 27/28* (2013.01); *H01F 27/29* (2013.01); *H01F 27/30* (2013.01); *H01F 27/325* (2013.01); *H01F 2005/022* (2013.01)

(58) Field of Classification Search

CPC ..... H01F 27/2823; H01F 5/02; H01F 27/24; H01F 27/325; H01F 27/29; H01F 2005/022; H01F 27/306

See application file for complete search history.

(56) References Cited

U.S. PATENT DOCUMENTS 7,772,957 B2 * 8/2010 Chen et al.
2012/0273266 A1 11/2012 Lin et al.

FOREIGN PATENT DOCUMENTS

| | | | |
|---|---|---|---|
| JP | H06325943 | A | 11/1994 |
| JP | H10149932 | A | 6/1998 |
| TW | 201243877 | A | 11/2012 |

* cited by examiner

*Primary Examiner* — Tuyen T Nguyen
(74) *Attorney, Agent, or Firm* — Oliff PLC

(57) ABSTRACT

A coil device includes a bobbin, a core body, a wire, and a plurality of terminals. The bobbin includes a pair of connection side portions and a pair of terminal tables. The pair of connection side portions is arranged near both sides of a winding core of the core body and wound by the wire along with the winding core. The pair of terminal tables is arranged on both ends of the connection side portions and respectively includes the terminal protruding outward in a winding axis of the winding core. The core body includes a pair of flanges arranged on both ends of the core body in the winding axis. Each of the terminal tables includes a flange storage recess configured to contain the flange.

16 Claims, 16 Drawing Sheets

COIL DEVICE

BACKGROUND OF THE INVENTION

The present invention relates to a low-profile coil device having a high withstand voltage.

In the prior art shown in Patent Document 1 below, for example, a coil where a troidal core is directly wound by a wire is put into a mold terminal box, and a leading part of the wire is connected.

In such conventional techniques, since a wire is wound around a troidal core, workability is poor, and coil characteristics vary. In addition, since a core is wound and thereafter put into a mold terminal box, the terminal box is hard to be thinner. Moreover, a troidal core is fixed unstably, and there is a problem with withstand voltage.

In the prior art shown in Patent Document 2 below, a bobbin covers the entire surface of a core as a main component, and a coil is formed by winding a wire around an outer circumference of the bobbin. In this coil device, the entire surface of the core is covered with the bobbin, and withstand voltage can be high.

In this prior art, however, the bobbin is entirely wound by the wire, and the coil device cannot thereby be low.

Patent Document 1: JPH06325943 (A)

Patent Document 2: JPH10149932 (A)

BRIEF SUMMARY OF INVENTION

The present invention has been achieved under such circumstances. It is an object of the invention to provide a low-profile coil device excelling in productivity and having less variation in characteristics and high withstand voltage.

To achieve the above object, a coil device according to the present invention comprises a bobbin, a core body, a wire, and a plurality of terminals, wherein the bobbin comprises:

a pair of connection side portions arranged near both sides of a winding core of the core body and wound by the wire along with the winding core; and a pair of terminal tables arranged on both ends of the connection side portions and respectively including the terminal protruding outward in a winding axis of the winding core, the core body includes a pair of flanges arranged on both ends of the core body in the winding axis, and each of the terminal tables includes a flange storage recess configured to contain the flange.

In the coil device according to the present invention, a coil is not formed by directly winding the wire around a troidal core, but is formed by winding the wire around the winding core of the core body along with the connection side portions, which are a part of the bobbin, while the core body is being attached to the bobbin. Thus, the wire is easily wound, and the coil device according to the present invention is excellent in productivity and has less variation in characteristics.

In the coil device according to the present invention, the bobbin does not entirely cover the winding core of the core body, but covers only both sides of the winding core or both sides and the bottom surface of the winding core and does not cover at least the top surface (or either the top or bottom surface) of the winding core. Thus, this reduces the height of the bobbin and consequently reduces the height of the coil device.

Moreover, each of the terminals is attached to protrude outward in the winding axis of the terminal table and is thereby prevented from unnecessarily protruding in the height direction of the coil device. This also reduces the height of the coil device.

Moreover, the flanges of the core body are housed in the flange storage recesses of the terminal tables, and withstand voltage is thereby improved.

Preferably, the wire is a conductive wire (also referred to as an insulation wire) whose outer circumference is covered with an insulation film. Moreover, the insulation film has substantially no pinholes. Since the wire partially contacts with the surface of the core body, the wire and the core can be insulated by the insulation film, and a conductive core, such as a metal core, can be used as the core body.

Preferably, each of the terminals comprises:

a wire joint part protruding from the terminal table and configured to connect with a leading end of the wire;

an embedded part integrally formed with the wire joint part and embedded in the terminal table; and a mount part integrally formed with the embedded part and protruding from the terminal table at a different position from the wire joint part.

In this structure, the wire joint part is easily joined with the wire, and the coil device is easily mounted. Moreover, the terminals are easily formed integrally with the bobbin.

Preferably, the wire joint part and the mount part protrude outward from each of the terminal tables to be displaced in a height direction of the coil device. In this structure, the wire joint part is easily joined with the wire, and the coil device is easily mounted. Moreover, the terminals are easily formed integrally with the bobbin.

Preferably, the pair of terminal tables is integrally formed with the pair of connection side portions, and the wire is continuously wound so as to contact with the pair of connection side portions and top and bottom surfaces of the winding core.

In this structure, the coil device can easily have a small height.

Instead, the pair of terminal tables is integrally formed with the pair of connection side portions, the bobbin further comprises a bottom wall integrating the pair of connection side portions and covering a bottom surface of the winding core, and the wire is continuously wound so as to contact with the pair of connection side portions, the bottom wall, and a top surface of the winding core.

In this structure, withstand voltage is improved.

A partition wall may be formed at an intermediate position of the connection side portions in the winding axis, and the wires differing from each other are wound in sections of the connection side portions divided by the partition wall in the winding axis. In this structure, the insulation between the primary coil and the secondary coil is improved.

Preferably, an opening of the flange storage recess of the terminal table includes adhesive recesses configured to store an adhesive on flange wings protruding outward from both sides of the flange while the flange is being contained in the flange storage recess. The core body and the bobbin are easily fixed only by flowing an adhesive into the adhesive recesses. The core body and the bobbin are easily positioned, and variations in characteristics can be prevented.

Preferably, the terminal tables respectively include a notch configured to be inserted by a boundary part between the winding core and the flange. In this structure, the core body is easily attached and positioned to the bobbin, and workability is improved.

Preferably, both ends of a plate differing from the core body are inserted from above into the notches. In this structure, the plate, the core body, and the bobbin are thereby easily positioned and attached. Incidentally, the plate may be the same as or a different magnetic material from a magnetic material of the core body. In this case, magnetic characteristics are improved. Instead, the plate is not necessarily formed by a magnetic material. In this case, the plate can function as, for example, a suction part of the coil device.

Preferably, the terminal tables respectively include a notch configured to be inserted by a boundary part between the winding core and the flange, both ends of a plate differing from the core body are inserted from above into the notches, and the flange wings are positioned on both sides of the ends of the plate in the flange storage recess.

Preferably, each of the adhesive recesses is positioned on the flange wings. The adhesive recesses are filled with an adhesive, and this adhesive simultaneously joins the plate, the core body, and the bobbin. Preferably, the plate has a width that is smaller than a width of the flange. The plate may have a width that is substantially equal to a width of the winding core.

Preferably, a conductor passage where a leading part of the wire passes and goes to the terminal is formed on a bottom surface of the terminal table located opposite to an opening of the flange storage recess. In this structure, the wire is easily joined, and the insulation between the core body and the leading part is improved.

DETAILED DESCRIPTION OF INVENTION

Hereinafter, the present invention is described based on embodiments shown in the figures.

First Embodiment

Figure 1:
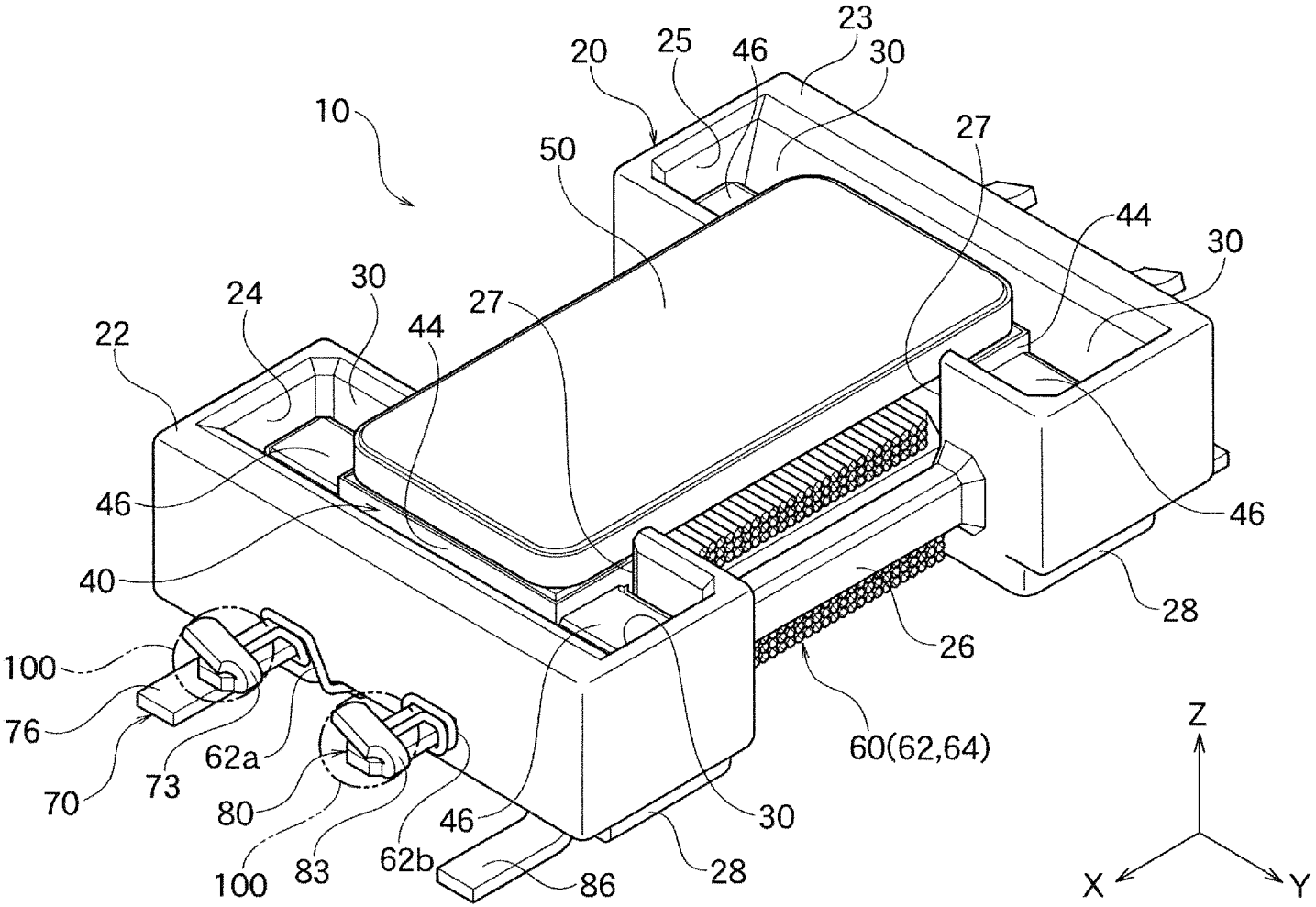
FIG. 1 a perspective view of a coil device according to an embodiment of the present invention.

A transformer 10 as a coil device according to the present embodiment shown in FIG. 1 is used as, for example, a transformer, and is used for voltage conversion of battery of vehicles, such as automobiles, voltage conversion of battery of electronic devices, and the like, but is used for any purposes. The transformer 10 has a bobbin 20, a core body 40, a plate 50, and a coil 60.

Figure 5:
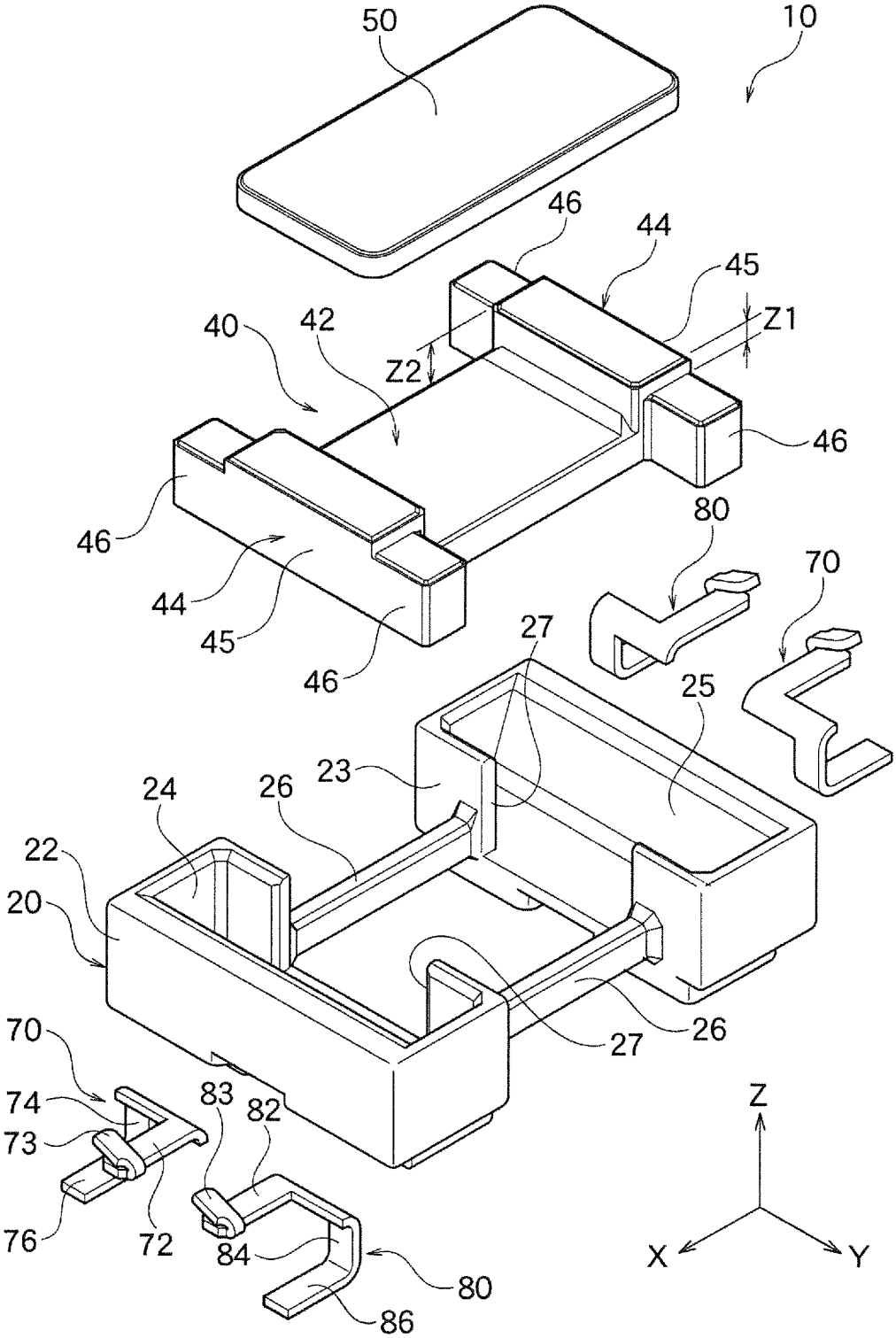
FIG. 5 is an exploded perspective view of the coil device (no illustration for wires) show in FIG. 1.

As shown in FIG. 5, the bobbin 20 has a pair of terminal tables 22 and 23 arranged separately in the X-axis direction. The terminal tables 22 and 23 are connected by a pair of bar connection side portions 26 and are integrated. The pair of connection side portions 26 is separated in the Y-axis direction and extends in the X-axis direction. The terminal table 22 (23) is provided with a flange storage recess 24 (25) having an opening on their upper part in the Z-axis direction. Preferably, a taper inclined surface is formed in the openings of the flange storage recesses 24 and 25 for easy entrance of flanges 44 of the core body 40 mentioned below.

In the figures, the X-axis, the Y-axis, and the Z-axis are mutually substantially perpendicular. In the present embodiment, the X-axis substantially corresponds to a direction where the connection side portions 26 extend (also corresponding to the winding axis direction of the coil 60), the Y-axis substantially corresponds to a direction where the pair of connection side portions 26 separates from each other, the Z-axis direction corresponds to a height direction of the transformer 10, and the lower side of the Z-axis direction is a mounting surface side.

As shown in FIG. 5, the core body 40 has a winding core 42 with a plane shape and a pair of flanges 44 arranged on both ends of the winding core 42 in the X-axis direction. Each of the flanges 44 has a flange central part 45 having a width in the Y-axis direction that is substantially the same as that of the winding core 42. A pair of flange wings 46 is integrally formed on both sides of each flange central part 45 in the Y-axis direction and is configured to protrude outward in the Y-axis direction from both ends of the winding core 42 in the Y-axis direction. Incidentally, "outward" means a go-away direction from a center (center of gravity) of the transformer 10, and "inward" means a go-back direction to the center (center of gravity) of the transformer 10.

In the present embodiment, the flange central part 45 is configured to have a height in the Z-axis direction (hereinafter may merely be referred to as "height") that is higher than the flange wings 46, a step is formed on the top surface of each flange 44 in the Z-axis direction (hereinafter may merely be referred to as "top surface"), and the bottom surface of each flange 44 in the Z-axis direction (hereinafter may merely be referred to as "bottom surface") are substantially flush. The steps formed on the top surfaces of the flanges 44 have any height Z1, but preferably have a height Z1 of about 0.6 to 1.1 mm.

The bottom surface of the winding core 42 is substantially flush with the bottom surfaces of the flange central parts 45. The winding core 42 has a thickness in the Z-axis direction (hereinafter may merely be referred to as "thickness") that is substantially equal to a thickness of each connection side portion 26. The bottom surfaces of the connection side portions 26 are substantially flush with the bottom surfaces of the flange storage recesses 24 and 25.

Figure 7:
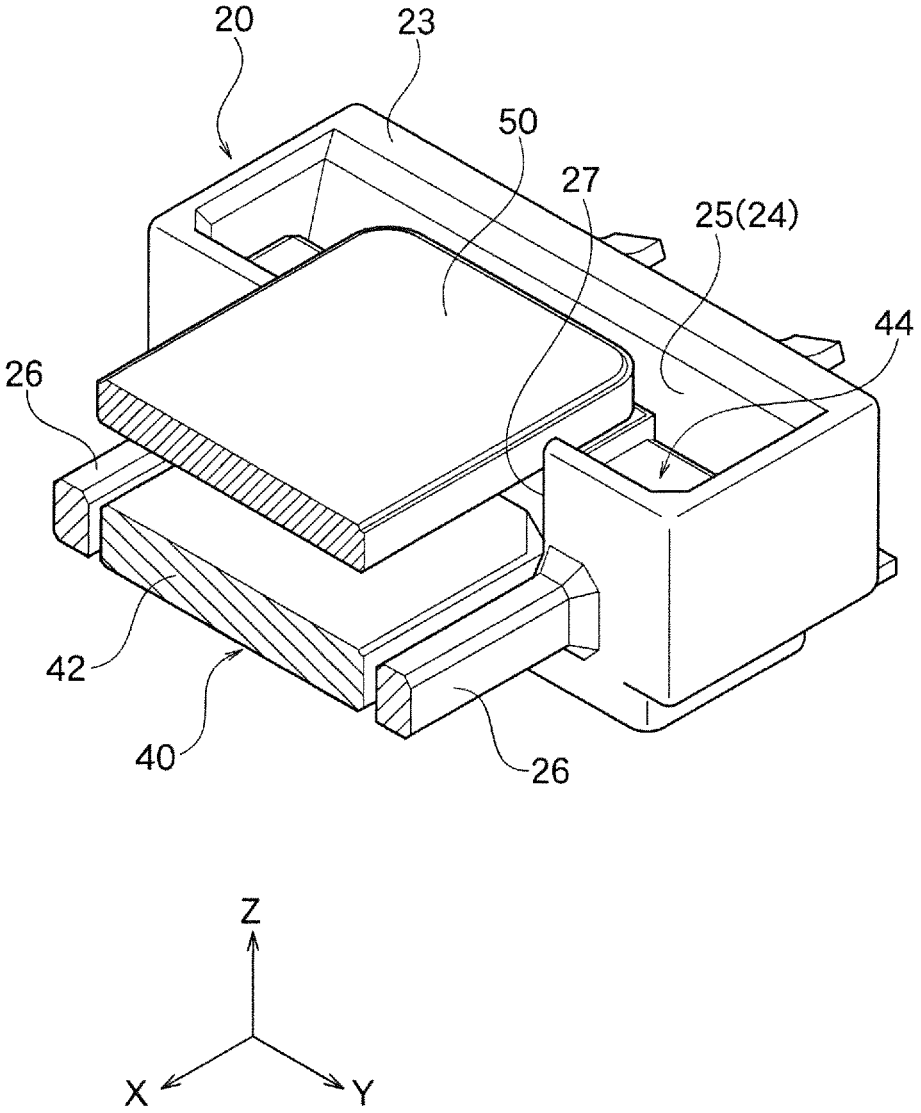
FIG. 7 is a cross-sectional perspective view of the coil device (no illustration for wires) shown in FIG. 1.

In the present embodiment, when the flanges 44 are contained in the flange storage recesses 24 and 25 of the terminal tables 22 and 23, as shown in FIG. 7, the winding core 42 of the core body 40 is located between the pair of connection side portions 26, the top surface of the winding core 42 and the top surfaces of the connection side portions 26 substantially correspond to each other, and the bottom surface of the winding core 42 and the bottom surfaces of the connection side portions 26 correspond to each other. Incidentally, "substantially correspond" means that a slight gap is permissible if no errors occur in the following winding operation of wires 62 and 64.

The height Z2 of the steps from the top surface of the winding core 42 to the top surfaces of the flange central parts 45 shown in FIG. 5 is needed to form a predetermined gap (corresponding to the height Z2) between the top surface of the winding core 42 and the bottom surface of the plate 50. The height Z2 of the steps shown in FIG. 5 is determined depending on the winding layer number of wires 62 and 64 constituting the coil 60 shown in FIG. 2 or so, and is preferably 0.6 to 1.1 mm.

The plate 50 is prepared separately from the core body 40. The plate 50 has a length that is substantially equal to a length of the core body 40 in the X-axis direction (hereinafter may merely be referred to as "length") and has a width that is substantially equal to a width of the winding core 42 of the core body 40 in the Y-axis direction (hereinafter may merely be referred to as "width"). Preferably, the plate 50 has a thickness that is 70 to 130% of a thickness of the winding core 42.

The core body 40 is formed by any material, such as a metal or a magnetic material of ferrite etc. The plate 50 is preferably formed by a magnetic material similar to a material of the core body 40, but is not necessarily formed by the identical magnetic material. The plate 50 may be formed by a non-magnetic material, such as a synthetic resin.

As shown in FIG. 5, a notch 27 is formed on the inner wall of each terminal table 22 (23) of the bobbin 20 in the X-axis direction. Each of the notches 27 has a width that is equal to or larger than a width of the winding core 42 and is smaller than a distance between the pair of connection side portions 26 in the Y-axis direction. Each of the notches 27 has a height that is substantially equal to a depth (height) of the flange storage recess 24 (25).

Figure 2:
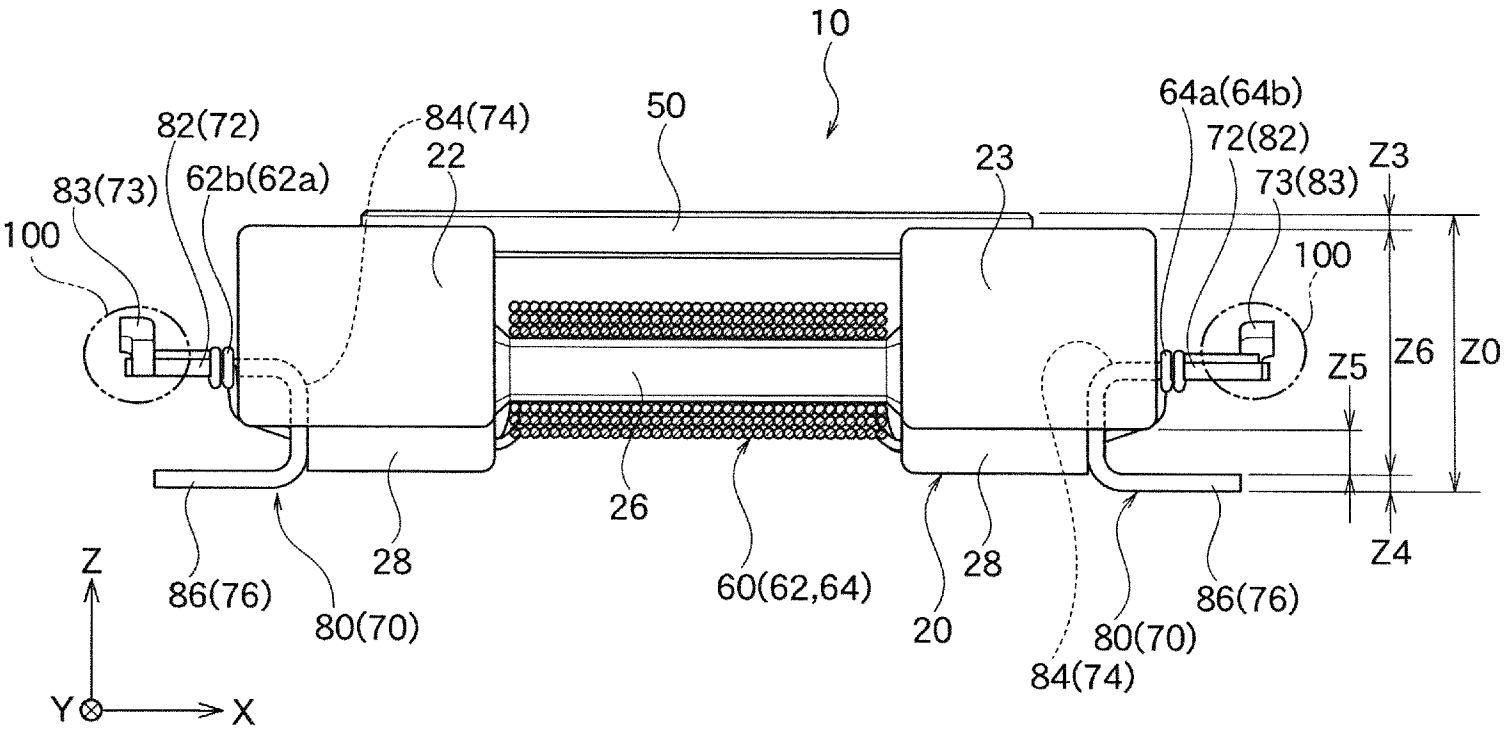
FIG. 2 is a front view (cross-sectional view for only wires) of the coil device shown in FIG. 1.

Boundary parts of the core body 40 between the winding core 42 and the flanges 44 are inserted into the notches 27, the flanges 44 are contained in the flange storage recesses 24 and 25, and the winding core 42 is disposed between the pair of connection side portions 26. Both ends of the plate 50 differing from the core body 40 are respectively inserted into the notches 27 from above, and the top surface of the plate 50 is configured to protrude upward in the Z-axis direction from the top surfaces of the terminal tables 22 and 23 with a predetermined height Z3 as shown in FIG. 2. The predetermined height Z3 is preferably ½ or less, more preferably ¼ or less, of a thickness of the plate 50. The top surface of the plate 50 may be flush with the top surfaces of the terminal tables 22 and 23 or may be lower than the top surfaces of the terminal tables 22 and 23 in the Z-axis direction.

Each of the terminal tables 22 and 23 of the bobbin 20 shown in FIG. 5 is provided with a pair of terminals 70 and 80. The terminals 70 and 80 have a line-symmetry shape and have a similar structure, but are not completely the same member.

The terminal 70 has a wire joint part 72, an embedded part 74, and a mount part 76, and these are integrally formed by pressing a conductive plate material, such as a metal piece. The wire joint part 72 is integrally formed with a caulking piece 73. The terminal 80 has a wire joint part 82, an embedded part 84, and a mount part 86, and these are integrally formed by pressing a conductive plate material, such as a metal piece. The wire joint part 82 is integrally formed with a caulking part 83. The terminals 70 and 80 are formed by any conductive material, such as a metal of phosphor bronze, tough pitch steel, oxygen-free steel, stainless steel, brass, copper nickel alloy, etc.

As shown in FIG. 2, the embedded part 74 (84) of the terminal 70 (80) is embedded in an insulation material constituting the bobbin 20 located outside the terminal table 22 (23) in the X-axis direction and located below the terminal table 22 (23) in the Z-axis direction. Preferably, the embedded part 74 (84) is not exposed on the inner wall surface of the flange storage recess 24 (25) of the terminal table 22 (23), but is embedded in the insulation material constituting the bobbin 20.

The insulation material constituting the bobbin 20 is any insulation material, such as a synthetic resin of LCP, nylon, phenol, DAP, PBT, PET, etc. The terminal 70 (80) is subjected to an insertion molding in the formation of the bobbin 20 and is integrated therewith.

As shown in FIG. 2, the mount part 76 (86) of the terminal 70 (80) is attached to the bobbin 20 so as to protrude outward in the X-axis direction from the end surface of the terminal table 22 (23) on the lower surface (bottom surface) of the bobbin 20. The wire joint part 72 (82) is attached to the bobbin 20 so as to protrude outward in the X-axis direction from the end surface of the terminal table 22 (23) at a position that is higher than the mount part 76 (86) in the Z-axis direction.

Figure 3:
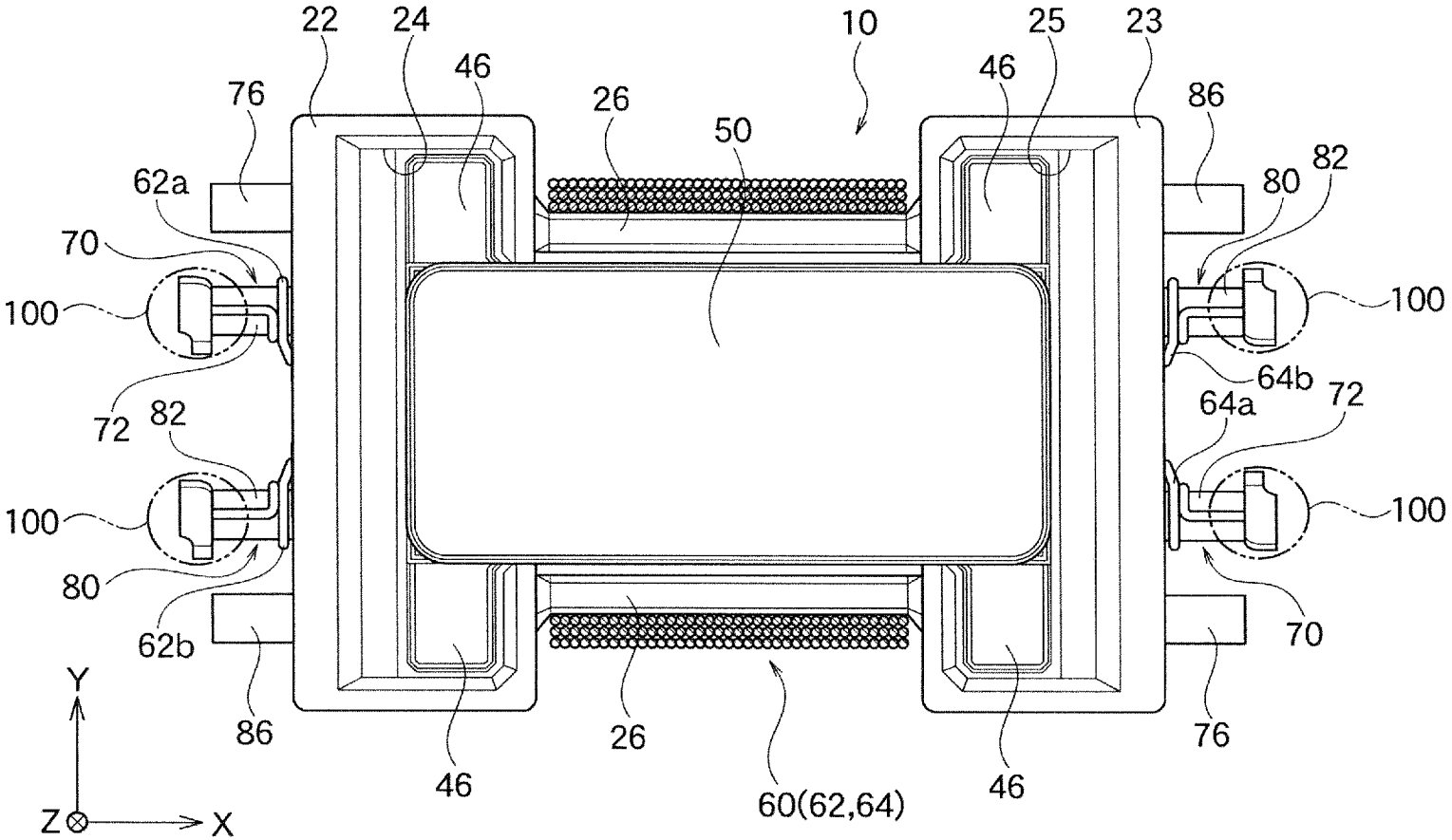
FIG. 3 is a plane view (cross-sectional view for only wires) of the coil device shown in FIG. 1.
Figure 4:
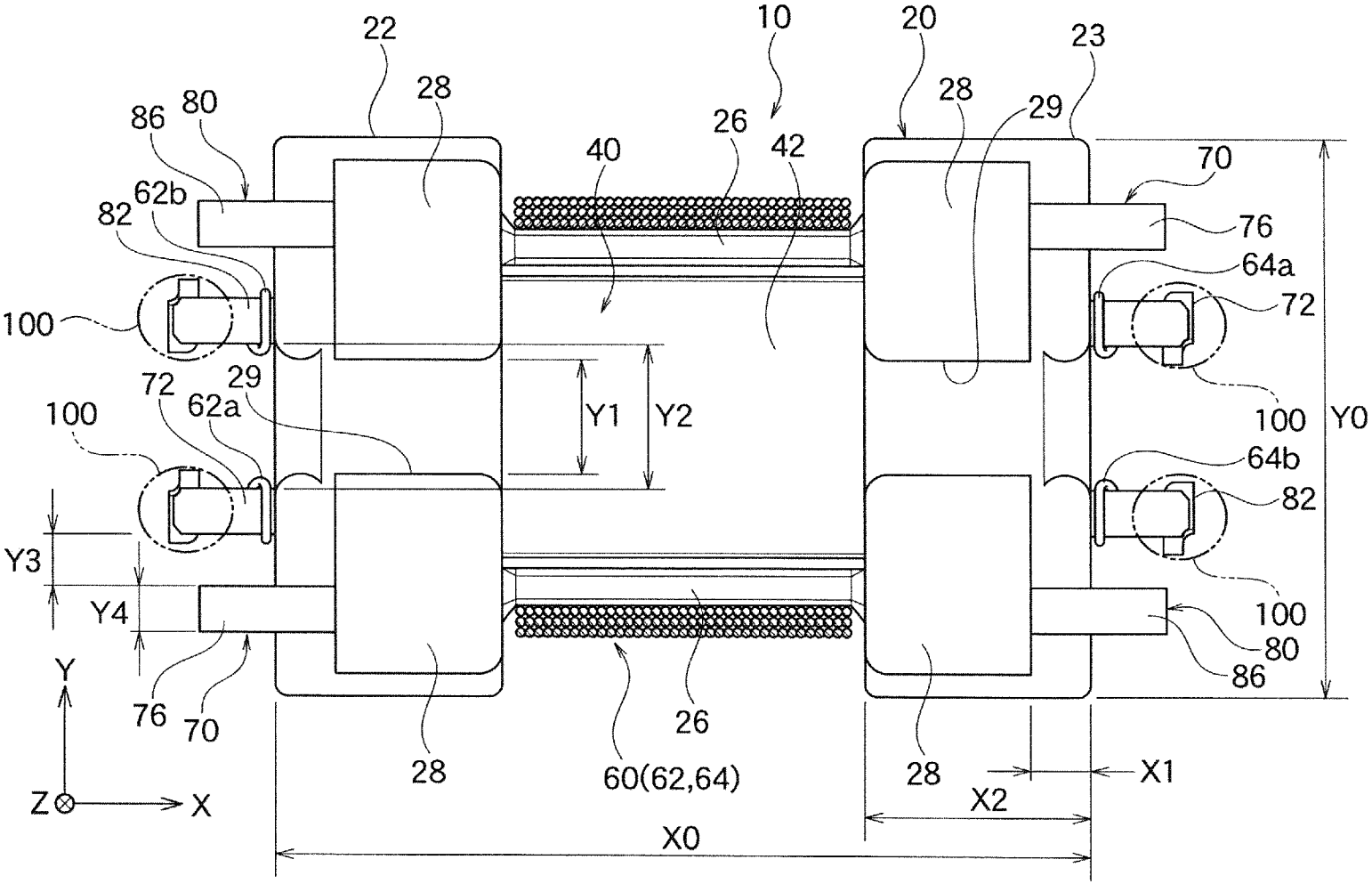
FIG. 4 is a bottom view (cross-sectional view for only wires) of the coil device shown in FIG. 1.

As shown in FIG. 3 and FIG. 4, the wire joint part 72 (82) and the mount part 76 (86) of the terminal 70 (80) are displaced in the Y-axis direction when viewed in the Z-axis direction. In the present embodiment, the embedded part 74 (84) shown in FIG. 5 is embedded in the insulation material constituting the bobbin 20 so that the wire joint parts 72 and 82 are positioned inside the mount parts 76 and 86 in the Y-axis direction.

Incidentally, the terminal 80 and the terminal 70 of the terminal table 22 are arranged side by side in this order in the Y-axis direction as shown in FIG. 3, but the terminal 70 and the terminal 80 of the terminal table 23 are arranged in this order.

As shown in FIG. 2, the lower surface of the mount part 76 (86) is configured to protrude downward from the bottom surface of the bobbin 20 with a predetermined height Z4. The predetermined height Z4 is preferably large than zero, and is preferably 0.5 to 2 times as large as a thickness of a plate material constituting the mount part 76 (86).

In the present embodiment, four mount-side protrusions 28 are formed in total on the bottom of the bobbin 20, and the bottom surfaces of the mount-side protrusions 28 are the bottom surface of the bobbin 20. As shown in FIG. 4, a pair of mount-side protrusions 28 is separately formed on the bottom surface of the terminal table 22 (23) in the Y-axis direction, and a leading communication groove (conductor passage) 29 is formed between the pair of mount-side protrusions 28.

The leading communication grooves 29 have a width Y1 in the Y-axis direction that is preferably substantially equal to or slightly smaller (or may be larger) than a distance Y2 in the Y-axis direction between the wire joint parts 72 and 82 arranged inside the terminal table 22 (23) in the Y-axis direction.

A displacement width Y3 between the wire joint part 72 (82) and the mount part 76 (86) is preferably larger than zero and smaller than ⅓ of a full width Y0 of the bobbin 20 in the Y-axis direction. Preferably, Y3/Y0 is ½ to 2 times as large as a width Y4 of the mount part 76 (86).

As shown in FIG. 4, the outer end surfaces of the mount-side protrusions 28 in the X-axis direction are preferably recessed from the outer end surface of the bobbin 20 in the X-axis direction with a predetermined distance X1. The predetermined distance X1 is determined in relation to a length X2 of the terminal table 22 (23) in the X-axis direction. X1/X2 is preferably ½ or less, more preferably ⅓ or less. X1/X2 may be zero, but is preferably ⅙ or more. The length X2 of the terminal table 22 (23) is determined based on a full length X0 of the bobbin 20 or so. Preferably, X2/X0 is 0.2 to 0.3.

In the present embodiment, as shown in FIG. 2, the mount parts 76 and 86 extend outward from the outer end surfaces of the mount-side protrusions 28 in the X-axis direction so as to protrude outside the outer end surface of the bobbin 20. In this structure, the outer end surfaces of the mount-side protrusions 28 reinforce the boundary parts between the mount parts 76 and 86 and the embedded parts 74 and 84, and the mount parts 76 and 86 are easily mounted on a mount surface, such as a circuit board.

Figure 6:
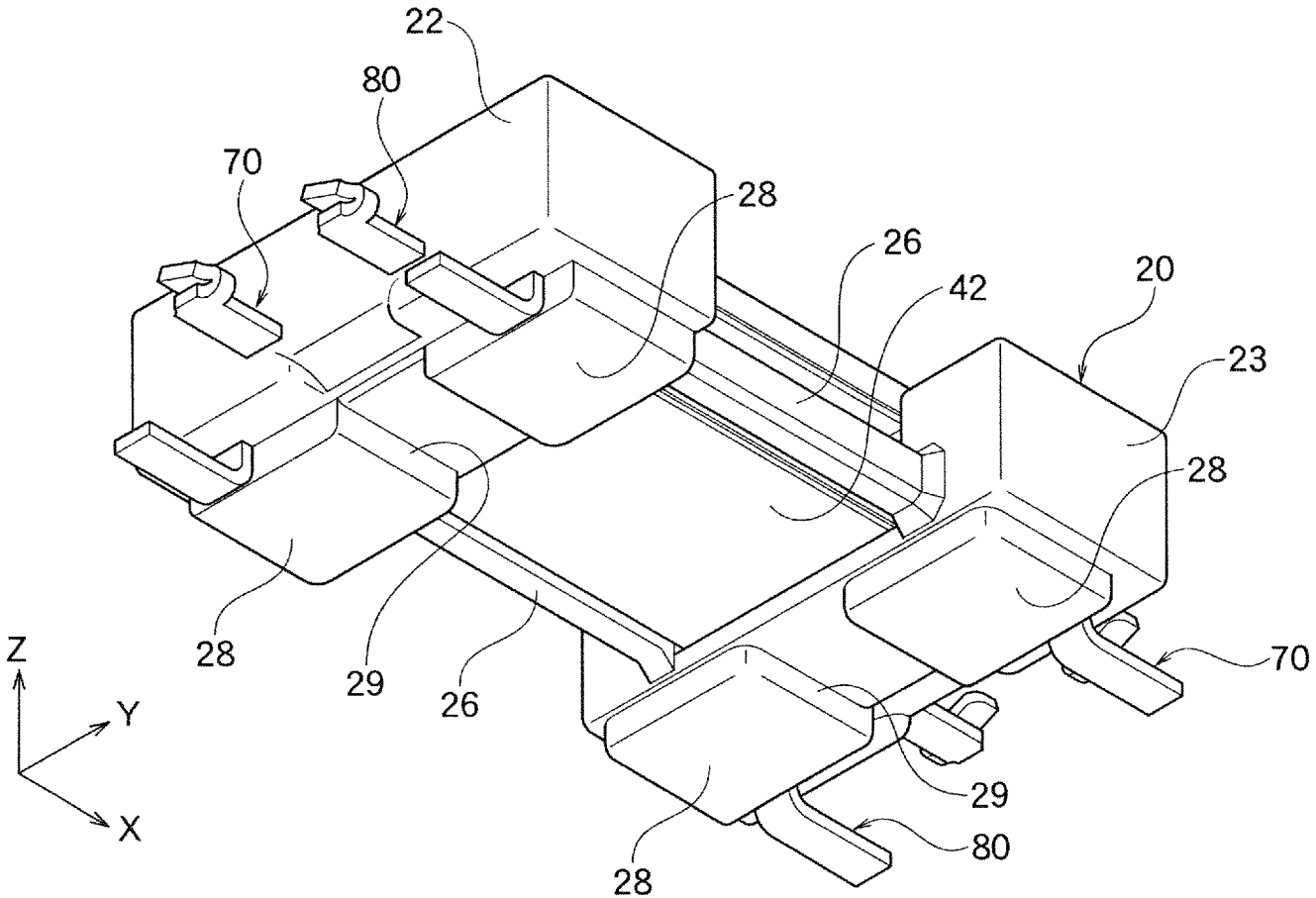
FIG. 6 is a perspective view of a bottom of the bobbin shown in FIG. 5.

Preferably, a protrusion height Z5 of the mount-side protrusions 28 is determined so as to sufficiently secure a depth of the flange storage recess 24 (25) shown in FIG. 1 and secure the leading communication grooves 29 shown in FIG. 6.

Figure 8:
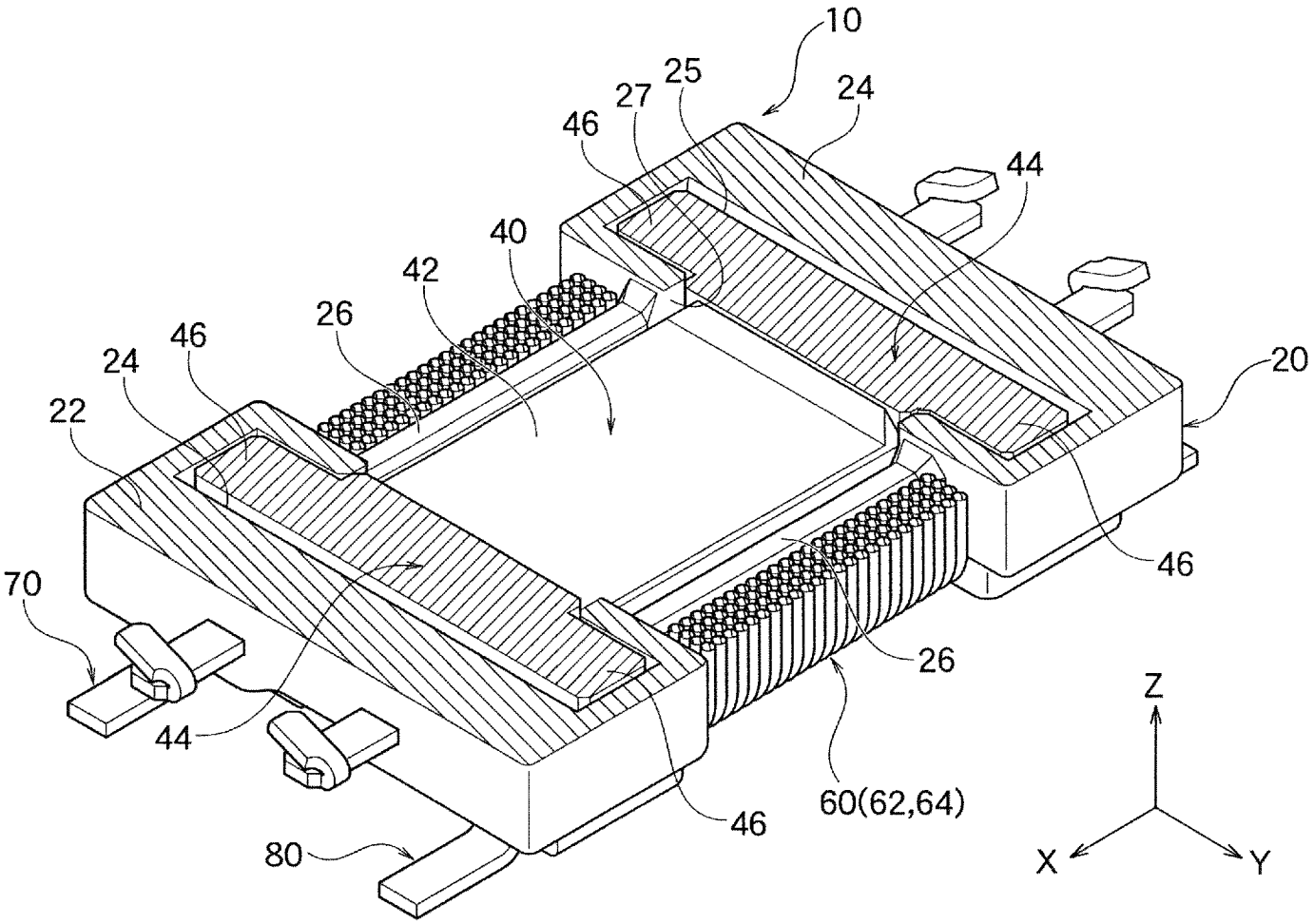
FIG. 8 is a perspective view of a cross section on the plane side of the coil device shown in FIG. 1.

In the present embodiment, as shown in FIG. 8, a slight gap may be formed in the Y-axis direction between the connection side portions 26 and the winding core 42 while the winding core 42 of the core body 40 is positioned between the pair of connection side portions 26. In this state, the connection side portions 26 sandwiching the winding core 42 are wound by two wires 62 and 64 constituting the coil 60.

The wires 62 and 64 are a conductive wire (also referred to as an insulation wire) whose outer circumference is covered with an insulation film. In the present embodiment, the insulation film has no pinholes. For example, the insulation film of the wires 62 and 64 may be polyurethane, ETFE, PFA, PET, polyamide, PPS, etc.

The wires 62 and 64 are wound from outside the connection side portions 26 sandwiching the winding core 42, and the coil 60 is thereby formed. The winding operation is preferably carried out automatically, but may be carried out manually. Both ends of the wire 62 pass the leading communication groove 29 shown in FIG. 4 and are respectively led to the wire joint parts 72 and 82 as leading parts 62*a* and 62*b*. Similarly, both ends of the wire 64 pass the leading communication groove 29 shown in FIG. 4 and are respectively led to the wire joint parts 72 and 82 as leading parts 64*a* and 64*b*.

The leading parts 62*a*, 62*b*, 64*a*, and 64*b* are wound around the wire joint parts 72 and 82 as necessary and are preliminary fixed by the caulking pieces 73 and 83. Then, joint portions 100 are formed at tips of the leading parts 62*a*, 62*b*, 64*a*, and 64*b* by laser radiation or so, and the leading parts 62*a*, 62*b*, 64*a*, and 64*b* and the wire joint parts 72 and 82 are electrically connected and fixed. In addition to laser radiation, the joint portions 100 can be formed by solder joint, a joint using a conductive adhesive, thermal fusion, resistance welding, etc.

In the present embodiment, the plate 50 is preferably attached to the bobbin 20 after the joint portions 100 shown in FIG. 1 are formed, but the plate 50 may be attached to the notches 27 of the bobbin 20 before the joint portions 100 are formed and after the wires 62 and 64 are wound to form the coil 60. After the plate 50 is attached, an adhesive is applied into adhesive recesses 30 formed on both sides of the flange storage recess 24 (25) in the Y-axis direction. The plate 50, the core body 40, and the bobbin 20 are simultaneously adhered and fixed by the application of the adhesive. The adhesive is any adhesive, such as silicone resin, epoxy resin, UV resin, and anaerobic resin.

In the transformer 10 according to the present embodiment, the coil 60 is not formed by directly winding a wire around a troidal core, but is formed by winding the wires 62 and 64 around the winding core 42 of the core body 40 along with the connection side portions 26, which are a part of the bobbin 20, while the core body 40 is being attached to the bobbin 20. Thus, the wires 62 and 64 are easily wound, and the transformer 10 according to the present embodiment is excellent in productivity and has less variation in characteristics.

In the transformer 10 according to the present embodiment, the bobbin 20 does not entirely cover the winding core 42 of the core body 40, but covers only both sides of the winding core 42 in the Y-axis direction and does not cover at least either the top or bottom surface of the winding core 42. Thus, this reduces the height of the bobbin 20 and consequently reduces the height of the transformer 10. In the present embodiment, a full height Z0 of the coil device 10 can preferably be 4 mm or less, more preferably 3.5 mm or less.

Moreover, the terminal 70 (80) is attached to protrude outward in the winding axis (X-axis) of the terminal table 22 (23), and the terminal 70 (80) is thereby prevented from unnecessarily protruding in the height direction (Z-axis direction) of the transformer 10. This also reduces the height of the transformer 10.

Moreover, the flanges 44 of the core body 42 are housed in the flange storage recesses 24 and 25 of the terminal tables 22 and 23, and withstand voltage is thereby improved. In the present embodiment, as shown in FIG. 4, a shortest distance between the core body 40 and the terminal 70 or 80 (insulation distance or creepage distance) can sufficiently be large (e.g., 5 mm or more), and insulation resistance is thereby excellent.

Moreover, the wires 62 and 64 are formed by a conductive wire (insulation wire) whose outer circumference is covered with an insulation film. This insulation film has substantially no pinholes. Since the wires 62 and 64 partially contact with the surface of the core body 40, the wires 62 and 64 and the core 40 can be insulated by the insulation film, and a conductive core, such as a metal core, can be used as the core body 40.

In the present embodiment, the terminal 70 (80) has the wire joint part 72 (82), the embedded part 74 (84), and the mount part 76 (86) protruding from the terminal table 22 (23) at a different position from the wire joint part 72 (82). In this structure, the wire joint part 72 (82) is easily joined with the wire 62 (64), and the transformer 10 is easily mounted. Moreover, the terminals 70 and 80 are easily formed integrally with the bobbin 20.

In the present embodiment, the wire joint part 72 (82) and the mount part 76 (86) are arranged to protrude outward in the X-axis direction from the terminal table 22 (23) while being displaced in the Z-axis direction. In this structure, the wire joint part 72 (82) is easily joined with the wire 62 (64), and the transformer 10 is easily mounted. Moreover, the terminals 70 and 80 are easily formed integrally with the bobbin 20.

In the present embodiment, the adhesive recesses 30 are formed in the flange storage recesses 24 and 25 of the terminal tables 22 and 23. The adhesive recesses 30 can store an adhesive on the flange wings 46 of the flanges 44 while the flanges 44 are being housed in the flange storage recesses 24 and 25. The core body 40 and the bobbin 20 are easily fixed only by flowing an adhesive into the adhesive recesses 30. The core body 40 and the bobbin 20 are easily positioned, and variations in characteristics can be prevented. Moreover, the core body 40 and the bobbin 20 can simultaneously be adhered and fixed with the plate 50.

Moreover, the terminal table 22 (23) is provided with the notch 27, where the boundary part between the winding core 42 and the flange 44 are inserted. Thus, the core body 40 is easily attached and positioned to the bobbin 20, and workability is improved. In addition, both ends of the plate 50, which is different from the core body 40, are respectively inserted into the notches 27 from above, and the plate 50, the core body 40, and the bobbin 20 are thereby easily positioned and attached. Incidentally, the plate 50 is not necessarily formed by a magnetic material. In this case, for example, the plate 50 can function as a suction part of a nozzle for mounter for moving a transformer in mounting it.

Moreover, as shown in FIG. 4, the leading communication grooves 29 as a conductor passage, where the leading parts 62*a*, 62*b*, 64*a*, and 64*b* of the wires 62 and 64 pass and go to the wire joint parts 72 and 82 of the terminals 70 and 80, are formed on the bottom surfaces of the terminal tables 22 and 23 located opposite to the openings of the flange storage recesses 24 and 25 in the Z-axis direction. In this structure, the wires 62 and 64 are easily joined, and the insulation between the core body 40 and the leading parts 62*a*, 62*b*, 64*a*, and 64*b* is improved.

Second Embodiment

A transformer 10*a* as a coil device according to the present embodiment shown in FIG. 9 to FIG. 16 has similar structure and similar effects to those of the transformer 10 shown in FIG. 1 to FIG. 8 except for the structure of the bobbin. In the following description, common parts are not described as much as possible, and different parts are selectively described. In the figures, common members are provided with common member references.

Figure 13:
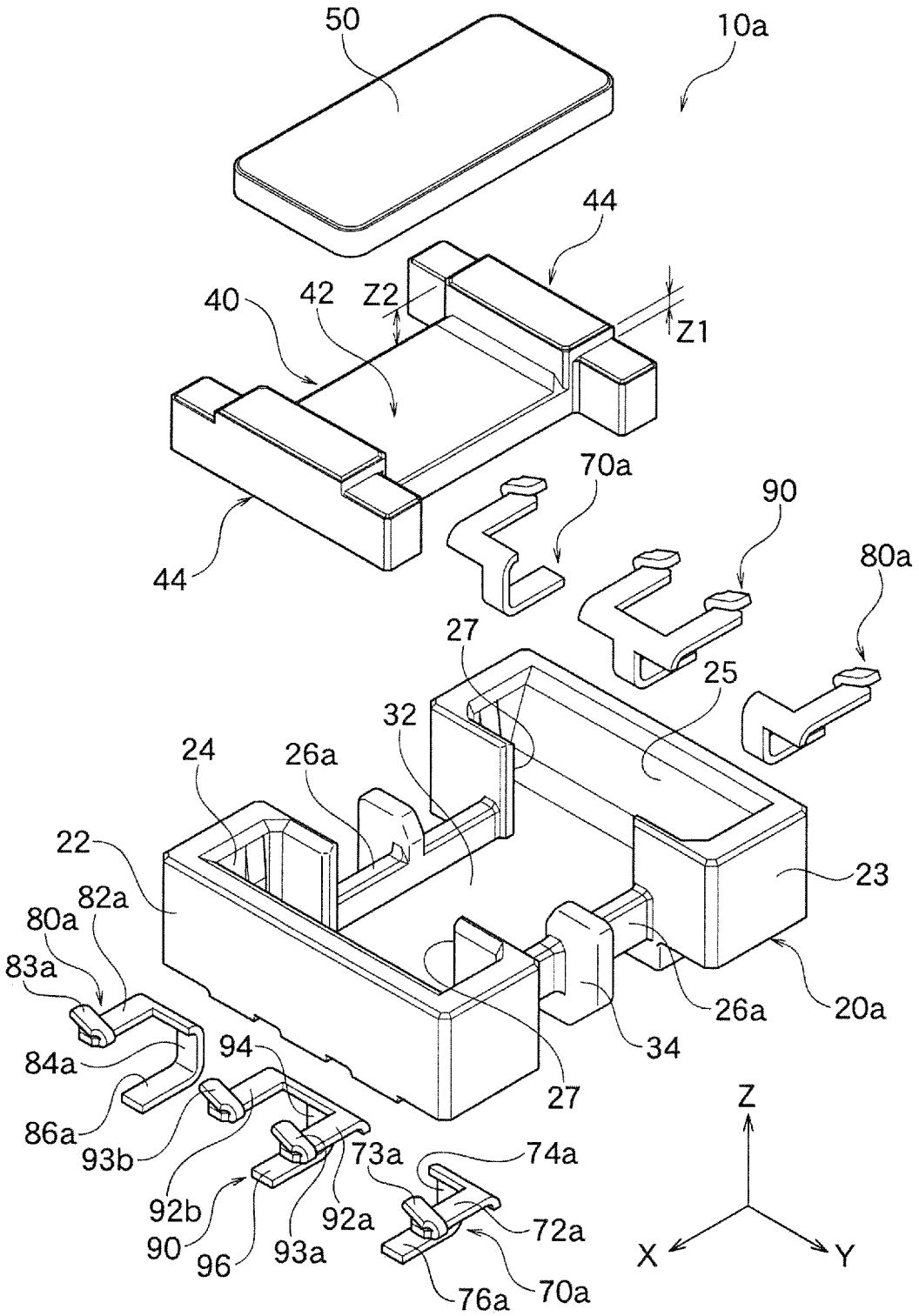
FIG. 13 is an exploded perspective view of the coil device (no illustration for wires) show in FIG. 9.

In a bobbin 20*a* of the present embodiment, as most clearly shown in FIG. 13, the pair of terminal tables 22 and 23 is integrally formed with a pair of connection side portions 26*a* having a plate wall shape, and a bottom wall 32 having a plate shape integrates the pair of connection side portions 26*a* and covers the entire bottom surface of the winding core 42 of the core body 40. The bottom wall 32 is also integrated with the terminal tables 22 and 23. Preferably, the top surface of the bottom wall 32 is substantially flush with the bottom surfaces of the flange storage recesses 24 and 25.

Figure 12:
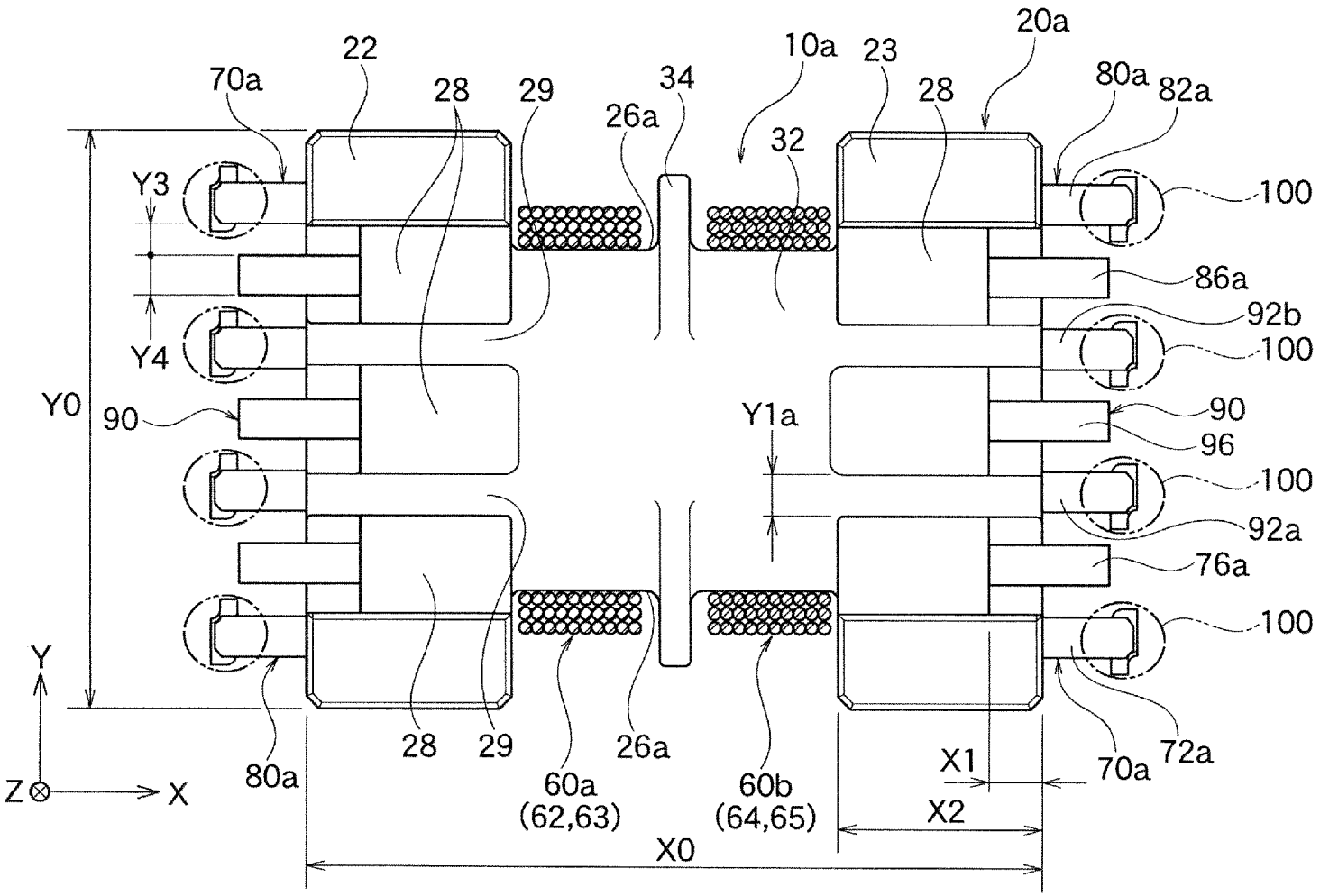
FIG. 12 is a bottom view (cross-sectional view for only wires) of the coil device shown in FIG. 9.

A partition wall 34 is formed at an intermediate position of the connection side portions 26*a* in the X-axis direction, and wires differing from each other are wound in divided sections in the X-axis direction. For example, as shown in FIG. 12, a coil 60*a* is constituted so that wires 62 and 63 are continuously wound so as to contact with the pair of connection side portions 26*a*, the bottom wall 32, and the top surface of the winding core 42 (see FIG. 1) in a region located closer to the terminal table 22, and a coil 60*b* is constituted so that wires 64 and 65 are continuously wound so as to contact with the pair of connection side portions 26*a*, the bottom wall 32, and the top surface of the winding core 42 (see FIG. 1) in a region located closer to the terminal table 23.

The coil 60*a* and the coil 60*b* are separated by the partition wall 34 in the X-axis direction, and for example, the insulation between a primary coil (coil 60*a*) and a secondary coil (coil 60*b*) is improved. Incidentally, the primary coil may be the coil 60*b*, and the secondary coil may be the coil 60*a*.

Three terminals 70*a*, 90, and 80*a* are attached to each of the terminal tables 22 and 23 of the bobbin 20*a* shown in FIG. 13. The terminal 70*a* and the terminal 80*a* have a mutually line-symmetry shape and have a similar structure, but are not completely the same member. Unlike the terminal 70*a* and the terminal 80*a*, the terminal 90 disposed between the terminal 70*a* and the terminal 80*a* in the Y-axis direction has two wire joint parts 92*a* and 92*b*.

The terminal 70*a* has a wire joint part 72*a*, an embedded part 74*a*, and a mount part 76*a*, and these are integrally formed by pressing a conductive plate material, such as a metal piece. The wire joint part 72*a* is integrally formed with a caulking piece 73*a*. The terminal 80*a* has a wire joint part 82*a*, an embedded part 84*a*, and a mount part 86*a*, and these are integrally formed by pressing a conductive plate material, such as a metal piece. The wire joint part 82*a* is integrally formed with a caulking part 83*a*. The terminals 70*a* and 80*a* are formed by a conductive material that is similar to the material of the terminals 70 and 80 according to First Embodiment.

The terminal 90 is a terminal used as, for example, a center tap, and has two wire joint parts 92*a* and 92*b*, an embedded part 94 formed integrally with the wire joint parts 92*a* and 92*b* so as to connect them, and a single mount part 96 continuing to the lower end of the embedded part 94. As is the case with the terminals 70*a* and 80*a*, the terminal 90 is also integrally formed by pressing a conductive plate material, such as a metal piece. The wire joint parts 92*a* and 92*b* are integrally formed with the caulking pieces 93*a* and 93*b*, respectively.

Figure 10:
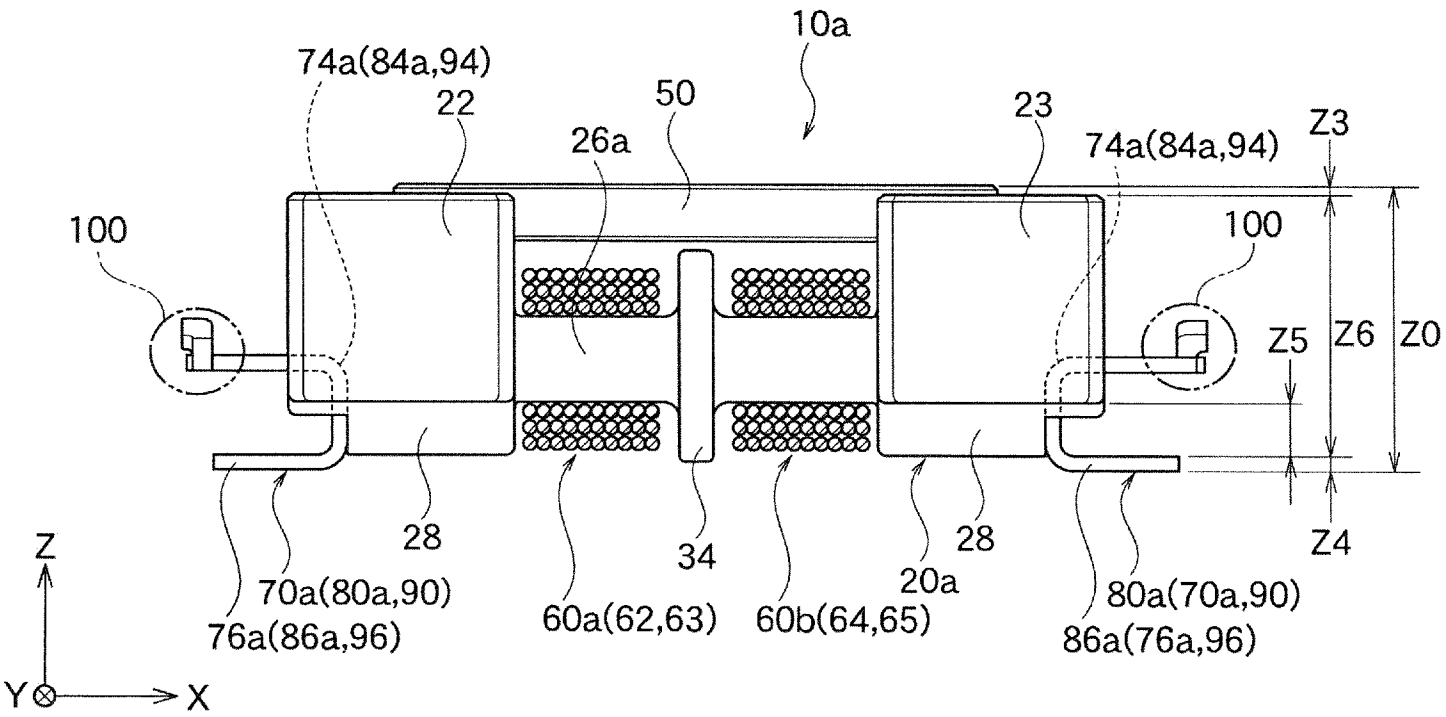
FIG. 10 is a front view (cross-sectional view for only wires) of the coil device shown in FIG. 9.

As shown in FIG. 10, the embedded parts 74*a*, 84*a*, and 94 of the terminals 70*a*, 80*a*, and 90 are embedded in an insulation material constituting the bobbin 20*a* located outside the terminal table 22 (23) in the X-axis direction and located below the terminal table 22 (23) in the Z-axis direction. Preferably, the embedded part 74*a*, 84*a*, and 94 are not exposed on the inner wall surface of the flange storage recess 24 (25) of the terminal table 22 (23), but are embedded in the insulation material constituting the bobbin 20*a*.

The insulation material constituting the bobbin 20*a* is similar to the insulation material constituting the bobbin 20 according to First Embodiment. The terminals 70*a*, 80*a*, and 90 are subjected to an insertion molding in the formation of the bobbin 20*a* and are integrated therewith.

As shown in FIG. 10, the mount parts 76*a*, 86*a*, and 96 of the terminals 70*a*, 80*a*, and 90 are attached to the bobbin 20*a* so as to protrude outward in the X-axis direction from the end surface of the terminal table 22 (23) on the lower surface (bottom surface) of the bobbin 20*a*. The wire joint parts 72*a*, 82*a*, and 92 are attached to the bobbin 20*a* so as to protrude outward in the X-axis direction from the end surface of the terminal table 22 (23) at a position that is higher than the mount parts 76*a*, 86*a*, and 96 in the Z-axis direction.

Figure 11:
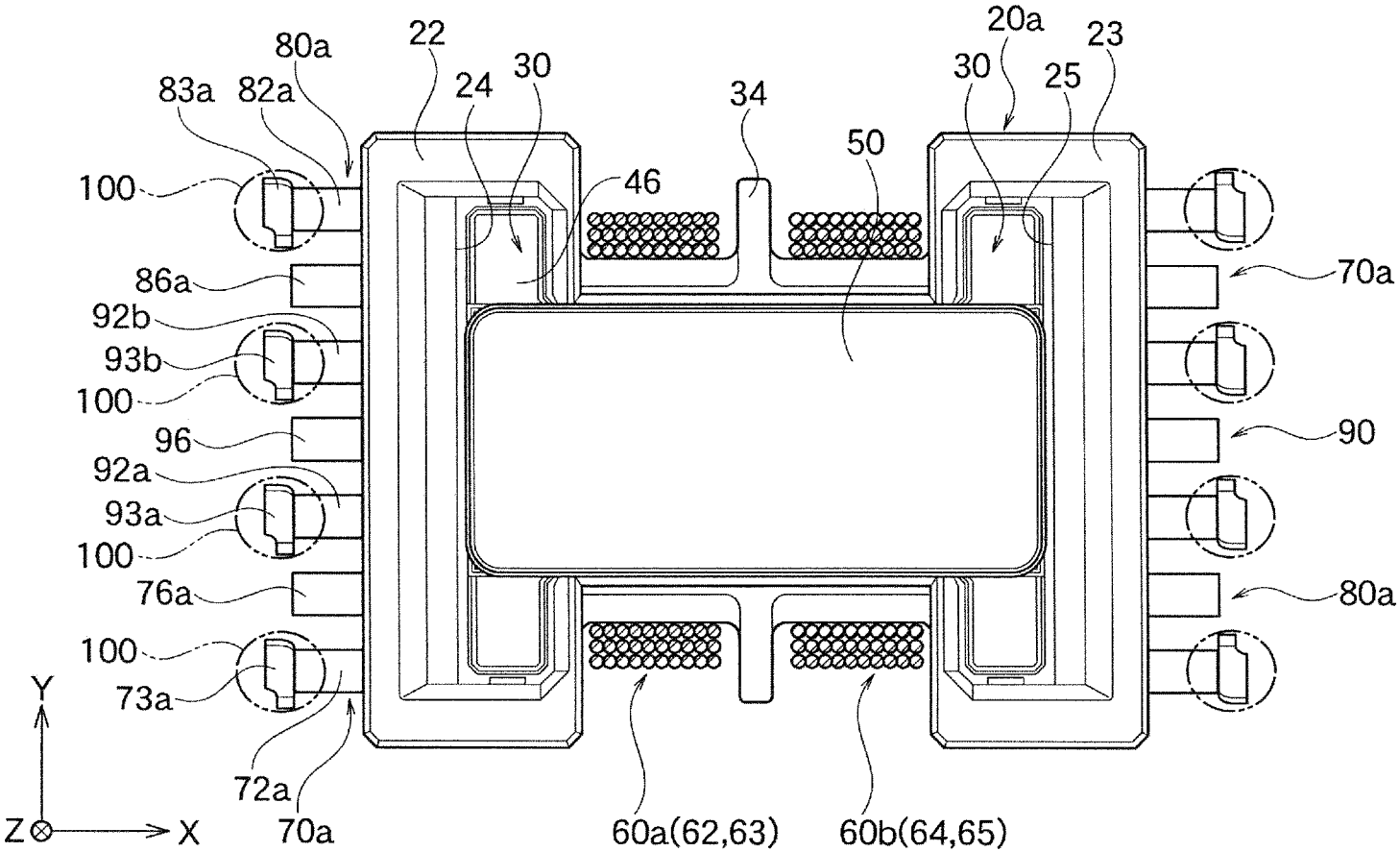
FIG. 11 is a plane view (cross-sectional view for only wires) of the coil device shown in FIG. 9.

As shown in FIG. 11 and FIG. 12, the mount parts 76*a*, 86*a*, and 96 and the wire joint parts 72*a*, 82*a*, 92*a*, and 92*b* of the terminals 70*a*, 80*a*, and 90 are displaced at substantially equal intervals in the Y-axis direction. In the present embodiment, the wire joint parts 72*a*, 92*a*, 92*b*, and 82*b* are arranged in this order at substantially equal intervals in the Y-axis direction, and the embedded parts 74*a*, 94, and 84*a* shown in FIG. 10 are embedded into the insulation material constituting the bobbin 20*a* so that the mount parts 76*a*, 96, and 86*a* are respectively arranged between the wire joint parts 72*a*, 92*a*, 92*b*, and 82*a* at substantially equal intervals.

Incidentally, as shown in FIG. 11, the terminals 70*a*, 90, 80*a* of the terminal table 22 are arranged side by side in this order in the Y-axis direction, but the terminals 80*a*, 90, and 70*a* of the terminal table 23 are arranged in this order.

As shown in FIG. 10, the bottom surfaces of the mount parts 76*a*, 86*a*, and 96 are configured to protrude downward from the bottom surface of the bobbin 20*a* with a predetermined height Z4. The predetermined height Z4 is similar to the predetermined height Z4 according to First Embodiment.

Figure 14:
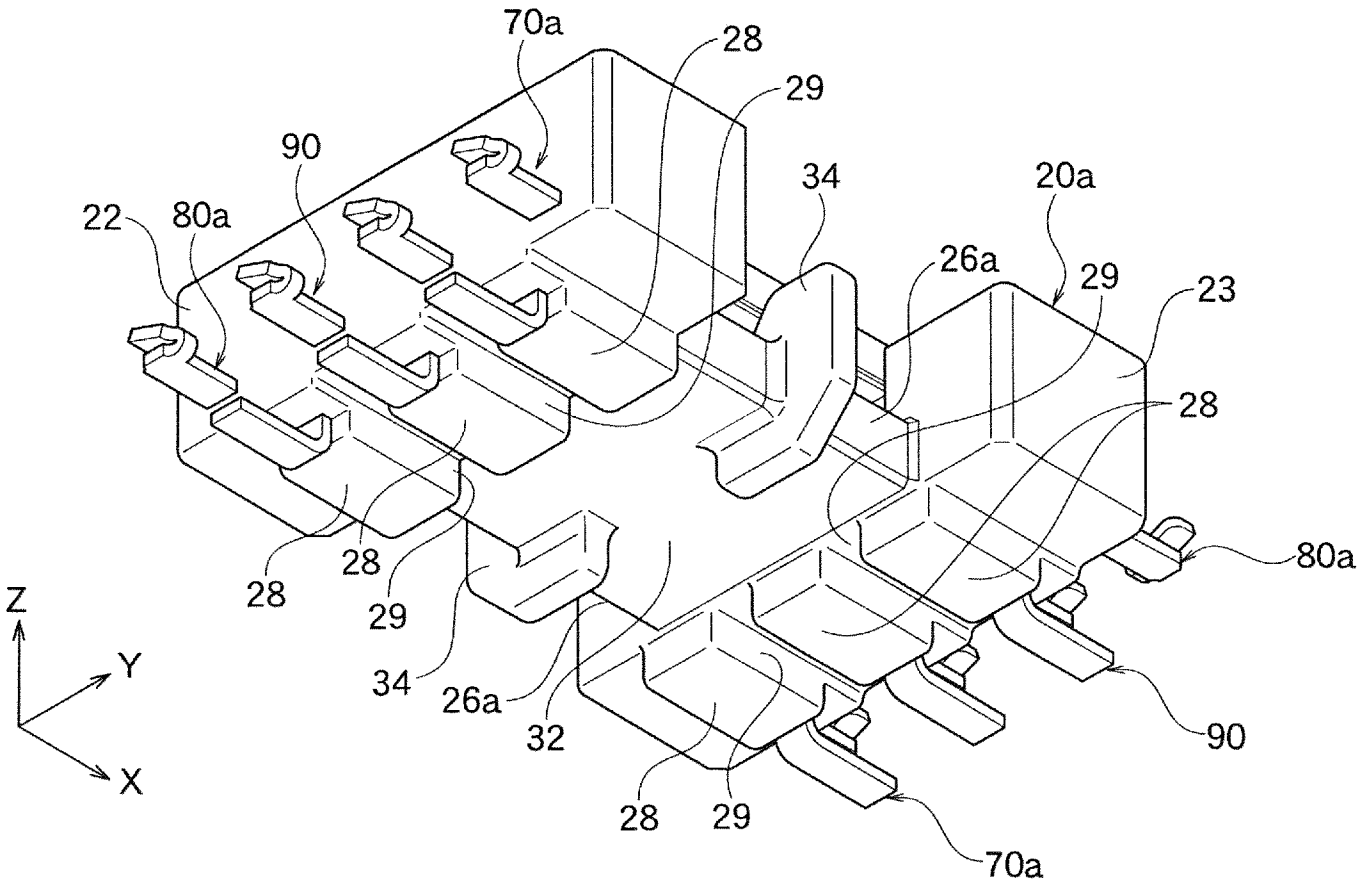
FIG. 14 is a perspective view of a bottom of the bobbin shown in FIG. 13.

In the present embodiment, as shown in FIG. 14, six mount-side protrusions 28 are formed in total on the bottom of the bobbin 20*a*, and the bottom surfaces of the mount-side protrusions 28 are the bottom surface of the bobbin 20*a*. As shown in FIG. 12, three mount-side protrusions 28 are respectively separately formed on the bottom surfaces of the terminal tables 22 and 23 in the Y-axis direction, and leading communication grooves (conductor passages) 29 are formed among the three mount-side protrusions 28.

The leading communication groove 29 has a width Y1*a* in the Y-axis direction that is preferably substantially equal to a width of the wire joint part 72*a* (82*a*, 92), but may be larger than a width of the wire joint part 72*a* (82*a*, 92). A displacement width Y3 between the wire joint part 72*a* (82*a*, 92) and the mount part 76*a* (86*a*, 96) is preferably larger than zero and substantially equal to or less than a width Y4 of the mount part 76*a* (86*a*, 96) in the present embodiment.

As shown in FIG. 12, the outer side surfaces of the mount-side protrusions 28 in the X-axis direction are preferably recessed from the outer end surface of the bobbin 20*a* in the X-axis direction with a predetermined distance X1. The predetermined distance X1 is determined similarly to First Embodiment. A length X2 of the terminal 22 (23) in the X-axis direction is also determined similarly to First Embodiment, but can be shorter than a length X2 according to First Embodiment as the bobbin 20*a* is provided with the bottom wall 32 in the present embodiment.

In the present embodiment, as shown in FIG. 10, the mount part 76*a* (86*a*, 96) extends outward from the outer end surface of the mount-side protrusion 28 in the X-axis direction so as to protrude outward from the outer end surface of the bobbin 20*a*. A protrusion height Z5 of the mount-side protrusions 28 is determined similarly to First Embodiment.

Figure 16:
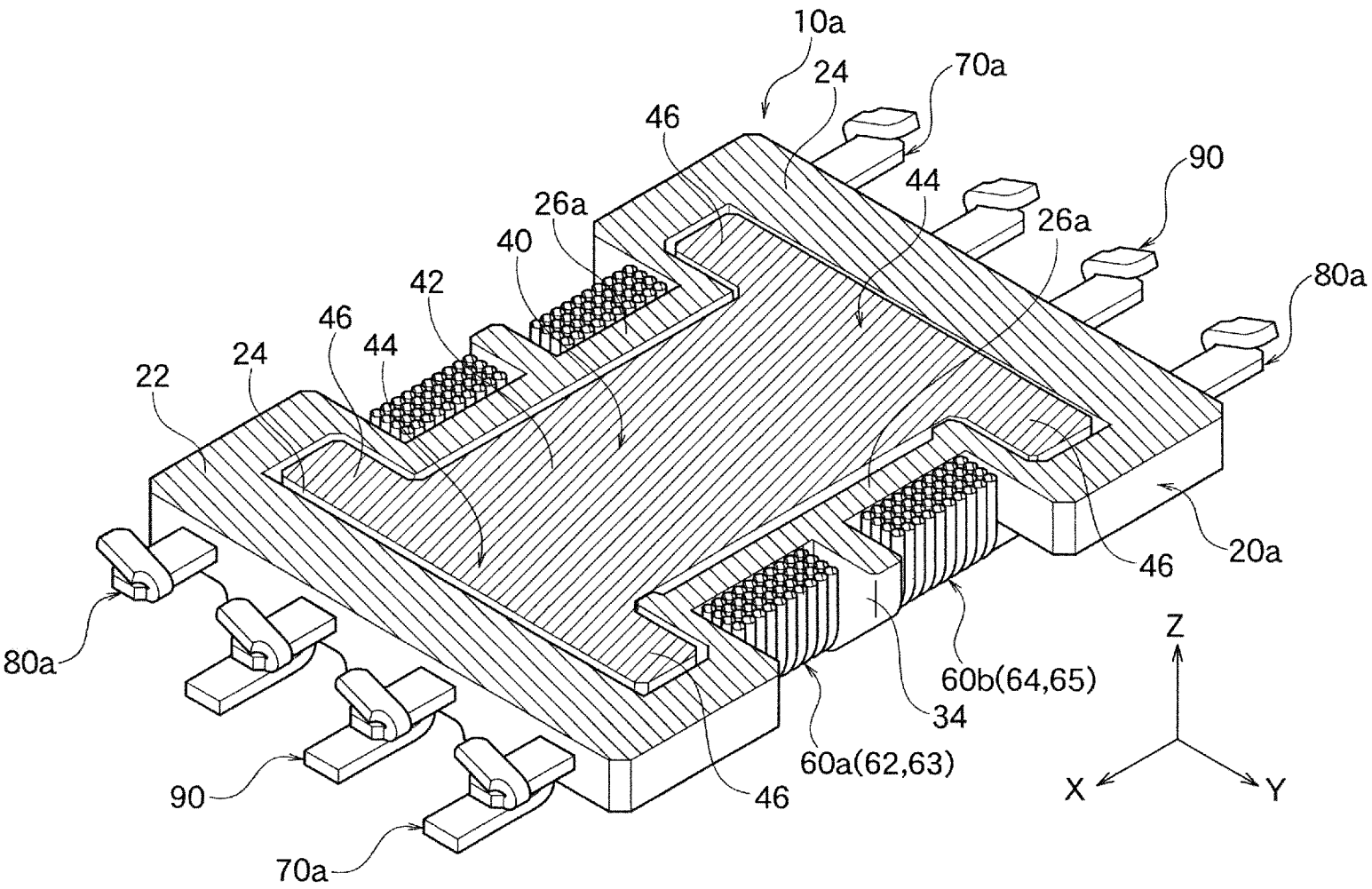
FIG. 16 is a perspective view of a cross section on the plane side of the coil device shown in FIG. 9.

In the present embodiment, as shown in FIG. 16, a slight gap may be formed in the Y-axis direction between the connection side portions 26*a* and the winding core 42 while the winding core 42 of the core body 40 is positioned between the pair of connection side portions 26*a* having a side wall shape. In this state, the connection side portions 26 sandwiching the winding core 42 and the bottom wall 32 located on the bottom surface of the winding core 42 (see FIG. 14) are wound by two wires 62 and 63 constituting the coil 60*a* and two wires 64 and 65 constituting the coil 60*b*.

The wires 62 to 65 are similar to the wires 62 and 64 according to First Embodiment. The wires 62 to 65 are wound around the winding core 42, the connection side portions 26, and the bottom wall 32, and the coils 60*a* and 60*b* are thereby formed. The winding operation is preferably carried out automatically, but may be carried out manually.

Figure 9:
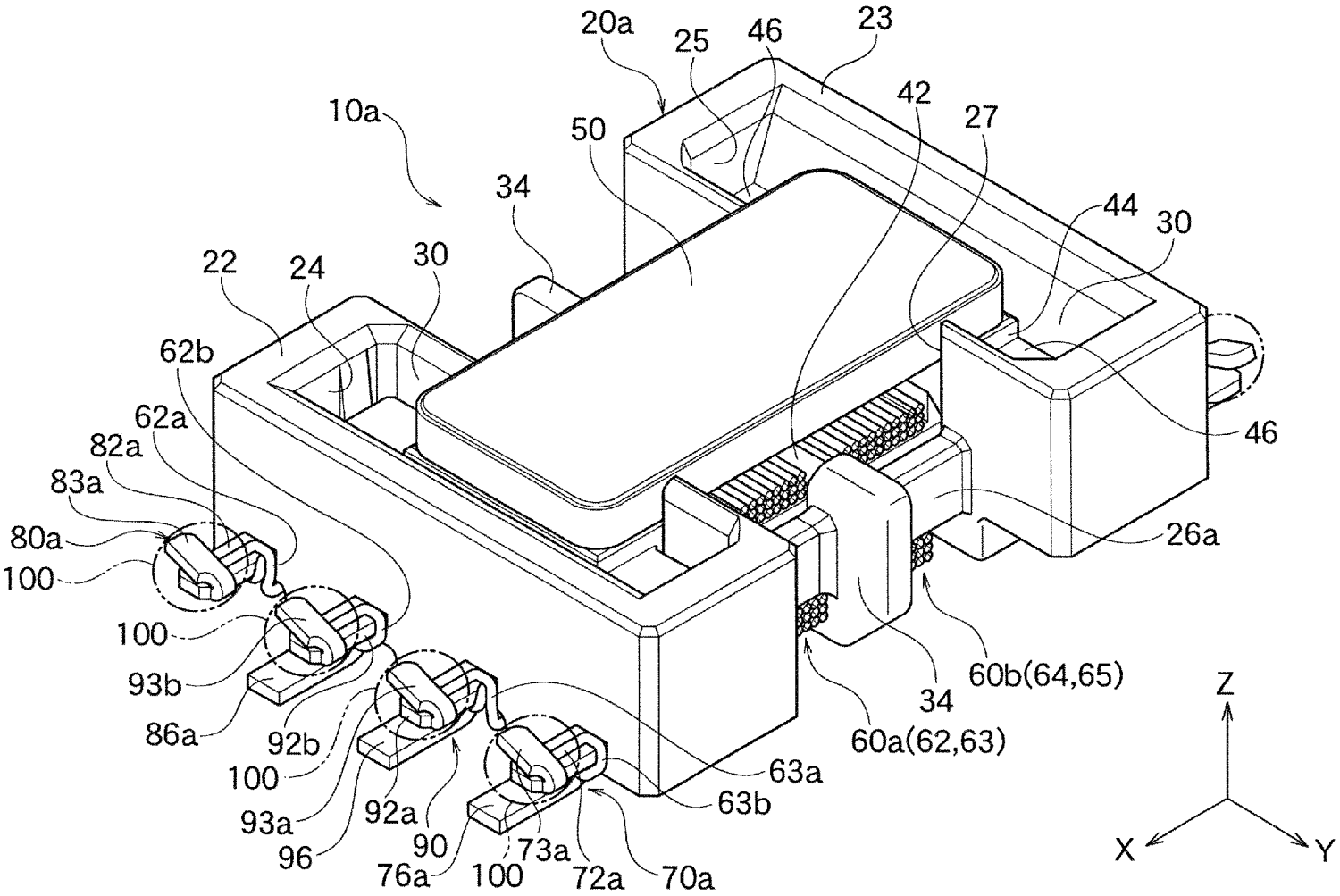
FIG. 9 is a perspective view of a coil device according to another embodiment of the present invention.

Both ends of the wire 62 constituting the coil 60*a* pass the leading communication groove 29 of the terminal table 22 shown in FIG. 14 and are respectively led to the wire joint parts 82*a* and 92*b* as leading parts 62*a* and 62*b* shown in FIG. 9. Similarly, both ends of the wire 63 pass the leading communication groove 29 of the terminal table 22 shown in FIG. 14 and are respectively led to the wire joint parts 92*a* and 72*a* as leading parts 63*a* and 63*b*.

The leading parts 62*a*, 62*b*, 63*a*, and 63*b* are wound around the wire joint parts 82*a*, 92*b*, 92*a*, and 72*a* as necessary and are preliminary fixed by the caulking pieces 83*a*, 93*b*, 93*a*, and 73*a*. Then, joint portions 100 are formed at tips of the leading parts 62*a*, 62*b*, 63*a*, and 63*b*, and the leading parts 62*a*, 62*b*, 63*a*, and 63*b* and the wire joint parts 82*a*, 92*b*, 92*a*, and 72*a* are electrically connected and fixed. Each leading part (not illustrated) of the wires 64 and 65 constituting the coil 60*b* are connected to the wire joint parts 82*a*, 92*b*, 92*a*, and 72*a* of the terminal table 23 shown in FIG. 12 similarly to the leading parts 62*a*, 62*b*, 63*a*, and 63*b* mentioned above, and the joint portions 100 are formed.

Figure 15:
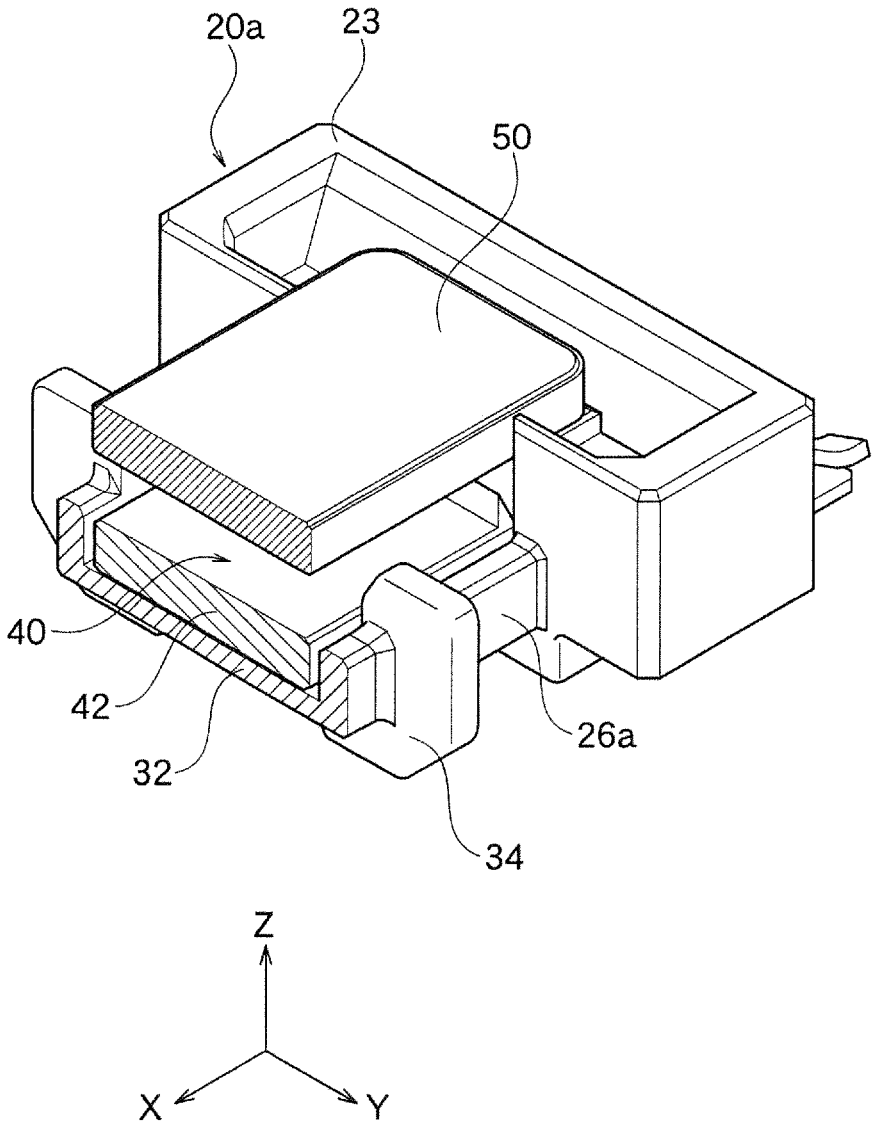
FIG. 15 is a cross-sectional perspective view of the coil device (no illustration for wires) shown in FIG. 9.

Except for the following effects, the transformer 10*a* according to the present embodiment demonstrates similar effects to those of the transformer 10 according to First Embodiment. In the present embodiment, the bobbin 20*a* does not entirely cover the winding core 42 of the core body 40, but covers only both sides of the winding core 42 in the Y-axis direction and the bottom surface of the winding core 42 and does not cover the top surface of the winding core 42. As shown in FIG. 15, the bottom wall 32 of the bobbin 20*a* may have a thickness (Z-axis direction) that is smaller than a thickness (Y-axis direction) of the connection side portions 26*a*.

In the present embodiment, the bobbin 20*a* has a small height, and the transformer 10*a* can thereby have a small height. In the present embodiment, the coil device 10*a* (see FIG. 10) can have a full height Z0 of preferably 4 mm or less, more preferably 3.5 mm or less.

In the present embodiment, withstand voltage is improved, since the flanges 44 of the core body 42 are embedded into the flange storage recesses 24 and 25 of the terminal tables 22 and 23, and the bottom surface of the winding core 42 in the Z-axis direction and both side surfaces of the winding core 42 in the Y-axis direction are integrally covered with the bottom wall 32 and the connection side portions 26*a*. In the present embodiment, a shortest distance between the core body 40 and the terminal 70 or 80 (insulation distance or creepage distance) can sufficiently be large (e.g., 5 mm or more), and insulation resistance is thereby excellent.

In the present embodiment, the pair of terminal tables 22 and 23 is formed integrally with the pair of connection side portions 26*a*, and the bobbin 20*a* further has the bottom wall 32 integrating the pair of connection side portions 26*a* and covering the bottom surface of the winding core 42. In the present embodiment, the wires 62 to 65 are furthermore continuously wound so as to contact with the pair of connection side portions 26*a*, the bottom wall 32, and the top surface of the winding core 42. In this structure, withstand voltage is improved.

In the present embodiment, the partition wall 34 is formed at an intermediate position of the connection side portions 26*a* in the X-axis direction, and the wires 62 and 63 (or 64 and 65) differing from each other are wound in a divided section in the X-axis direction. In this structure, the insulation between the primary coil 60*a* and the secondary coil 60*b* is improved.

Incidentally, the present invention is not limited to the above-mentioned embodiments, and may variously be changed within the scope of the present invention.

For example, the core 40 has any shape with a winding core and flanges, such as a so-called U-type core and a drum-type core. Moreover, the number of wires is not limited, and the number of terminals is not limited. The present invention may be an embodiment that combines the components of First and Second Embodiments mentioned above. For example, the connection side portions 26 of First Embodiment may be provided with the partition wall 34 of Second Embodiment. The coil device of the present invention may not have the plate 50.

DESCRIPTION OF THE REFERENCE NUMERICAL

10, 10*a* . . . transformer (coil device)
20, 20*a* . . . bobbin
22, 23 . . . terminal table
24, 25 . . . flange storage recess
26, 26*a* . . . connection side portion
27 . . . notch
28 . . . mount-side protrusion
29 . . . leading communication groove
30 . . . adhesive recess
32 . . . bottom wall
34 . . . partition wall
40 . . . core body
42 . . . winding core
44 . . . flange
45 . . . flange central part
46 . . . flange wing
50 . . . plate
60 . . . coil
62 to 65 . . . wire
62*a*, 62*b*, 63*a*, 63*b* . . . leading part
70, 70*a*, 80, 80*a*, 90 . . . terminal
72, 72*a*, 82, 82*a*, 92*a*, 92*b* . . . wire joint part
73, 73*a*, 83, 83*a*, 93*a*, 93*b* . . . caulking piece
74, 74*a*, 84, 84*a*, 94 . . . embedded part
76, 76*a*, 86, 86*a*, 96 . . . mount part
100 . . . joint portion

What is claimed is:

1. A coil device, comprising:
a core body including a pair of flanges arranged on both ends of the core body in a winding axis;
a wire;
a plurality of terminals; and
a bobbin comprising:
a pair of connection side portions arranged near both sides of a winding core of the core body and wound by the wire along with the winding core, the wire being continuously wound so as to contact the pair of connection side portions and top and bottom surfaces of the winding core; and
a pair of terminal tables arranged on both ends of the connection side portions and respectively including the terminal protruding outward in the winding axis of the winding core, each of the terminal tables including a flange storage recess configured to contain the flange.

2. The coil device according to claim 1, wherein the wire is a conductive wire whose outer circumference is covered with an insulation film.

3. The coil device according to claim 1, wherein each of the terminals comprises:
a wire joint part protruding from the terminal table and configured to connect with a leading end of the wire;
an embedded part integrally formed with the wire joint part and embedded in the terminal table; and
a mount part integrally formed with the embedded part and protruding from the terminal table at a different position from the wire joint part.

4. The coil device according to claim 3, wherein the wire joint part and the mount part protrude outward from each of the terminal tables to be displaced in a height direction of the coil device.

5. The coil device according to claim 1, wherein the pair of terminal tables is integrally formed with the pair of connection side portions.

6. A coil device, comprising:
a core body including a pair of flanges arranged on both ends of the core body in a winding axis;
a wire;
a plurality of terminals; and
a bobbin comprising:
a pair of connection side portions arranged near both sides of a winding core of the core body;
a pair of terminal tables arranged on both ends of the connection side portions and respectively including the terminal protruding outward in the winding axis of the winding core; and
a bottom wall integrating the pair of connection side portions and covering a bottom surface of the winding core, the wire being continuously wound so as to contact the pair of connection side portions, the bottom wall, and a top surface of the winding core.

7. The coil device according to claim 1, wherein
a partition wall is formed at an intermediate position of the connection side portions in the winding axis, and
the wires differing from each other are wound in sections of the connection side portions divided by the partition wall in the winding axis.

8. The coil device according to claim 1, wherein an opening of the flange storage recess of the terminal table includes adhesive recesses configured to store an adhesive on flange wings protruding outward from both sides of the flange while the flange is being contained in the flange storage recess.

9. The coil device according to claim 1, wherein the terminal tables respectively include a notch configured to be inserted by a boundary part between the winding core and the flange.

10. The coil device according to claim 9, wherein both ends of a plate differing from the core body are inserted from above into the notches.

11. The coil device according to claim 8, wherein
the terminal tables respectively include a notch configured to be inserted by a boundary part between the winding core and the flange,
both ends of a plate differing from the core body are inserted from above into the notches, and
the flange wings are positioned on both sides of the ends of the plate in the flange storage recess.

12. The coil device according to claim 1, wherein a conductor passage where a leading part of the wire passes and goes to the terminal is formed on a bottom surface of the terminal table located opposite to an opening of the flange storage recess.

13. The coil device according to claim 6, wherein
a partition wall is formed at an intermediate position of the connection side portions in the winding axis, and
the wires differing from each other are wound in sections of the connection side portions divided by the partition wall in the winding axis.

14. The coil device according to claim 6, wherein an opening of the flange storage recess of the terminal table includes adhesive recesses configured to store an adhesive on flange wings protruding outward from both sides of the flange while the flange is being contained in the flange storage recess.

15. The coil device according to claim 6, wherein the terminal tables respectively include a notch configured to be inserted by a boundary part between the winding core and the flange.

16. A coil device, comprising:

a core body including a pair of flanges arranged on both ends of the core body in a winding axis;

a wire;

a plurality of terminals; and a bobbin comprising:

a pair of connection side portions arranged near both sides of a winding core of the core body, the wire being continuously wound so as to contact the pair of connection side portions and extend on or over a top surface or a bottom surface of the winding core which is not covered by the bobbin; and a pair of terminal tables arranged on both ends of the connection side portions and respectively including the terminal protruding outward in the winding axis of the winding core, each of the terminal tables including a flange storage recess configured to contain the flange.

* * * * *